US006779664B1

(12) United States Patent
Bermann

(10) Patent No.: US 6,779,664 B1
(45) Date of Patent: Aug. 24, 2004

(54) DEVICE FOR DISPENSING SANDWICHES

(76) Inventor: Ronnie J. Bermann, 3207 Newcastle Dr., Houston, TX (US) 77027-5509

( * ) Notice: Subject to any disclaimer, the term of this patent is extended or adjusted under 35 U.S.C. 154(b) by 196 days.

(21) Appl. No.: 10/075,671

(22) Filed: Feb. 15, 2002

(51) Int. Cl.[7] ..... B65D 83/00

(52) U.S. Cl. ..... 206/541; 426/115; 206/804; 206/817; 222/391; 229/938

(58) Field of Search ..... 426/115, 128; 222/386, 391, 392; 206/804, 817, 541; 401/176, 181; 229/938

(56) References Cited

U.S. PATENT DOCUMENTS

| | | | | |
|---|---|---|---|---|
| 851,586 | A | * | 4/1907 | Clark |
| 1,830,246 | A | * | 11/1931 | Sanford |
| 1,958,524 | A | * | 5/1934 | Tooker |
| 2,145,481 | A | * | 1/1939 | Harvey |
| 2,157,476 | A | | 5/1939 | Brodesser |
| 2,162,224 | A | * | 6/1939 | Legge |
| 2,248,843 | A | | 7/1941 | Atwood |
| 2,356,874 | A | * | 8/1944 | Nageotte |
| 2,589,000 | A | * | 3/1952 | Vani |
| 2,885,110 | A | * | 5/1959 | Tregilgas |
| 3,003,207 | A | | 10/1961 | Powers |
| 3,036,702 | A | * | 5/1962 | Davis |
| 3,178,076 | A | * | 4/1965 | Kennedy |
| 3,229,865 | A | * | 1/1966 | Heisler et al. |
| 3,481,458 | A | * | 12/1969 | Mayeaux |
| 3,727,802 | A | * | 4/1973 | Schnurmacher |
| 4,350,712 | A | * | 9/1982 | Kocharian et al. |
| 4,394,906 | A | * | 7/1983 | Hollenbeck |
| 4,589,553 | A | | 5/1986 | Ferrero |
| 4,641,752 | A | * | 2/1987 | Palffy |
| D291,044 | S | * | 7/1987 | Canning |
| 4,708,273 | A | * | 11/1987 | Grant |
| 4,763,815 | A | * | 8/1988 | Schuckmann et al. |
| 4,821,906 | A | | 4/1989 | Clark |
| 4,874,115 | A | * | 10/1989 | Weihrauch |
| 4,940,190 | A | | 7/1990 | Groves |
| 4,955,572 | A | * | 9/1990 | Simmons |
| 4,957,254 | A | * | 9/1990 | Hill |
| 5,042,666 | A | | 8/1991 | Dolene |
| 5,050,759 | A | * | 9/1991 | Marble |
| 5,353,956 | A | | 10/1994 | Wilson |
| 5,356,037 | A | * | 10/1994 | Harrold |
| 5,421,663 | A | * | 6/1995 | Bravo |
| 5,429,262 | A | * | 7/1995 | Sharkey |
| 5,833,382 | A | * | 11/1998 | Jenks et al. |
| 5,860,587 | A | * | 1/1999 | Young |
| 6,260,731 | B1 | * | 7/2001 | Cummings |
| 6,261,611 | B1 | | 7/2001 | Berman |

FOREIGN PATENT DOCUMENTS

| | | | |
|---|---|---|---|
| DE | 3618399 | * | 12/1987 |
| DE | 3938433 | * | 5/1991 |
| GB | 2331743 | * | 6/1999 |

* cited by examiner

*Primary Examiner*—Steve Weinstein
(74) *Attorney, Agent, or Firm*—Harrison & Egbert

(57) ABSTRACT

A device for dispensing sandwiches including a tubular body having an oval cross-section and a disk member positioned interior of the tubular body. The tubular body has a slot extending longitudinally along and through a wall of the tubular body. The disk member has an arm extending outwardly therefrom. This arm extends outwardly of the tubular body through the slot. The wall of the tubular body is of a flexible material. The tubular body has a closed end and an open end. The disk member is a solid planar member extending transverse to the longitudinal axis of the tubular body. A guide rod is positioned within the tubular body and slidably receives the disk member thereon. The guide rod has a plurality of fixing elements suitable for retaining the disk member at a desired position within the tubular body.

10 Claims, 2 Drawing Sheets

DEVICE FOR DISPENSING SANDWICHES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to devices for dispensing sandwiches. More particularly, the present invention relates to holding devices for dispensing the sandwich during the consumption of the sandwich.

BACKGROUND OF THE INVENTION

Eating a sandwich is often a messy affair. Long French bread sandwiches, commonly known as "hero" or "sub" sandwiches, are particularly difficult to eat without liquid and other sandwich material falling from the sandwich.

Conventionally, such sandwiches are placed in a common bag or in the bag formed of a wrap of water resistant paper. As the sandwich is eaten, the consumer must move the remaining sandwich upwardly and crush or neck-down the bag or wrap below the bottom end of the sandwich. Such manipulation of the sandwich and bag is undesirable as the sandwich itself must often be handled by the consumer hands thereby soiling the hands or the sandwich or both. Sandwich parts always fall down into the bag and are squeezed and crushed and not eaten. In manipulating the sandwich to a higher position, sandwich parts often fall out anyway.

It is also extremely difficult to eat such a sandwich while driving. The two handed manipulation of the wrapper for such a sandwich is often difficult or impossible while the driver has his or her hands on the steering wheel of a vehicle. Often, the driver will place the sandwich on his or her lap while driving, thereby soiling his or her clothing. In other circumstances, accidents can occur by the undue manipulation of the sandwich by the driver. In any event, the eating of a sandwich while driving often is a very messy and complicated matter.

In the past, various U.S. patents have issued for devices relating to the dispensing of food products. In particular, U.S. Pat. No. 2,157,476, issued on May 9, 1939 to R. A. Brodesser, describes a dispensing container for food. This dispensing container includes a tubular member having a disk portion affixed therein. The disk member has a pair of arms extending outwardly of slots formed in the wall of the tubular member. The tubular member has a first open end and second open end. In particular, by moving the arms forwardly in the slot, the dispensing container can move ice cream, and other foodstuffs, outwardly of the open end of the container.

U.S. Pat. No. 2,248,843, issued on Jul. 8, 1941 to H. D. Atwood, teaches a lifting strip bag using a lifting strip for pulling the sandwich progressively from the bag as it is being eaten. The lifting strip is fashioned from a ribbon of sheet material doubled upon itself to form separate legs of unequal length. This strip is located within the bag and extends longitudinally with its folded end at the bottom of the bag and the end portion of the strip legs extending toward the mouth of the bag. The user will grip the flap and underlying strip leg between his or her thumb and forefinger and then slide the thumb along to pull the strip leg upwardly into a desired position. During such movement of the strip leg, the shorter strip leg is buckled so that the outer wall of the bag is thrust outward and the bag mouth opened.

U.S. Pat. No. 3,003,207, issued on Oct. 10, 1961 to C. Powers, describes a sandwich holder having a substantially circular pad portion with a pair of opposed integral strips. Each of the strips has a width substantially less than the diameter of the pad and notched adjacent their ends on opposite sides. A third integral strip extends from the pad portion at right angles to the first strip that is provided adjacent its ends with notches between extensions. The strip can then be lifted so as to expose the sandwich.

U.S. Pat. No. 4,589,533, issued on May 20, 1986 to P. Ferrero, describes a package for a rigid or semi-rigid food product that has a wrapper sheet which encloses the product and which can be torn along a transverse rupture line. The package includes a take-up member which at least partly surrounds the portion of the wrapper sheet between one end of the product and the rupture line. As a result, the product can be held for consumption.

U.S. Pat. No. 4,821,906, issued on Apr. 18, 1989 to C. Clark, describes an ice cream cone guard formed of a conical receptacle for supporting a cone. A shield is mounted in a slide for variable extension relative to the receptacle. The slide is mounted on a portion of a cylinder affixed to the receptacle with a protrusion on the slide provided so as to allow for manipulation by the user.

U.S. Pat. No. 4,940,190, issued on Jul. 10, 1990 to M. C. Groves, teaches a container for food having an open portion or an openable portion for presenting the food for consumption. A panel is provided with at least a partially frangible portion that can be urged from a position co-planar with a panel to a position extending outwardly of the panel such that when the portion is moved to the extended position, the food can be moved toward the open portion of the container.

U.S. Pat. No. 5,042,666, issued on Aug. 27, 2001 to T. Dolene, teaches a foldable sandwich bag having a wall of laminated structure and an outer wrap securely attached thereto to form a laminate. The outer layer is made of a thicker, stronger and tear-resistant material. The outer layer is configured in segments that can be tom away, along with the attached inner layer, to reveal the contents of the bag. The bag can be laminated in a flat configuration and formed into a bag with overlapping vertical seams and having a vertical separation between segments.

U.S. Pat. No. 5,353,956, issued on Oct. 1, 1994 to E. P. Wilson, describes a chewing gum dispenser designed to hold a standard pack of gum sticks. The dispenser has an internal sliding ejector with an attached, thumb-operated actuator protruding through a slot in the side of the dispenser body. In operation of the dispenser, the dispenser is held in one hand while the thumb slips open the hinged cap and subsequently moves the actuator and ejector forward so as to expose the end of the gum and make it available for grasping with the other hand. The remaining gum is then retracted by moving the actuator back with the thumb.

U.S. Pat. No. 6,261,611, issued on Jul. 17, 2001 to R. E. Berman, teaches a hand-held food package that enables heterogeneous foods to be shipped, stored and heated in the same disposable package. A handle is provided which will push the contents of the container outwardly of the open end of the container.

It is an object of the present invention to provide a device for dispensing sandwiches which allows the sandwiches to be consumed in a convenient and easy manner.

It is another object of the present invention to provide a device for dispensing sandwiches that allows the sandwich to be exposed from a container progressively as the sandwich is consumed.

It is another object of the present invention to provide a device for dispensing sandwiches which prevents the liquid contents of the sandwich from being released from the container.

It is a further object of the present invention to provide a device for dispensing sandwiches which can be easily used while driving a vehicle.

It is a further object of the present invention to provide a device for dispensing sandwiches which is disposable.

It is still a further object of the present invention to provide a device for dispensing sandwiches which is easy to use, relatively inexpensive and easy to manufacture.

These and other objects and advantages of the present invention will become apparent from a reading of the attached specification and appended claims.

BRIEF SUMMARY OF THE INVENTION

The present invention is a device for dispensing sandwiches comprising a tubular body having an oval cross-section and a disk member positioned interior of the tubular body. The tubular body has a slot extending longitudinally along and through a wall of the tubular body. The disk member has an arm extending outwardly therefrom. This arm extends outwardly of the tubular body through the slot.

In the preferred embodiment of the present invention, the wall of the tubular body is flexible. The tubular body has a closed end and an open end. The disk member is positioned adjacent to the closed end. The disk member is a solid planar member extending transverse to a longitudinal axis of the tubular body.

The slot comprises a first slot extending along and through the wall of the tubular body and a second slot extending along and through the wall of the tubular body on an opposite side of the tubular body from the first slot. The arm comprises a first arm extending through the first slot, and a second arm extending through the second slot.

In the present invention, a fixing means is positioned interior of the tubular body. This fixing means serves to set a position of the disk member within the tubular body along a length of the tubular body. The fixing means comprises a guide rod positioned within the tubular body adjacent to a wall of the tubular body. The disk member is slidably attached to the guide rod. The guide rod has a plurality of ratcheting elements. These ratcheting elements are suitable for retaining the disk member at a desired position within the tubular body along the longitudinal axis of the tubular body. The guide rod extends for less than an entire length of the tubular body.

A spring hook can be affixed to an exterior surface of the wall of the tubular body so as to allow the tubular body to be detachably affixed to dashboards, car doors, desk drawers, etc.

Within the concept of the present invention, the term "sandwich" can encompass a wide variety of food items. In particular, within the concept of the present invention, the term "sandwich" can include the hero or sub-type sandwiches. Additionally, and furthermore, the term sandwich can refer to items such as hamburgers and hot dogs and various other types of elongated sandwich types.

DETAILED DESCRIPTION OF THE INVENTION

Figure 1:
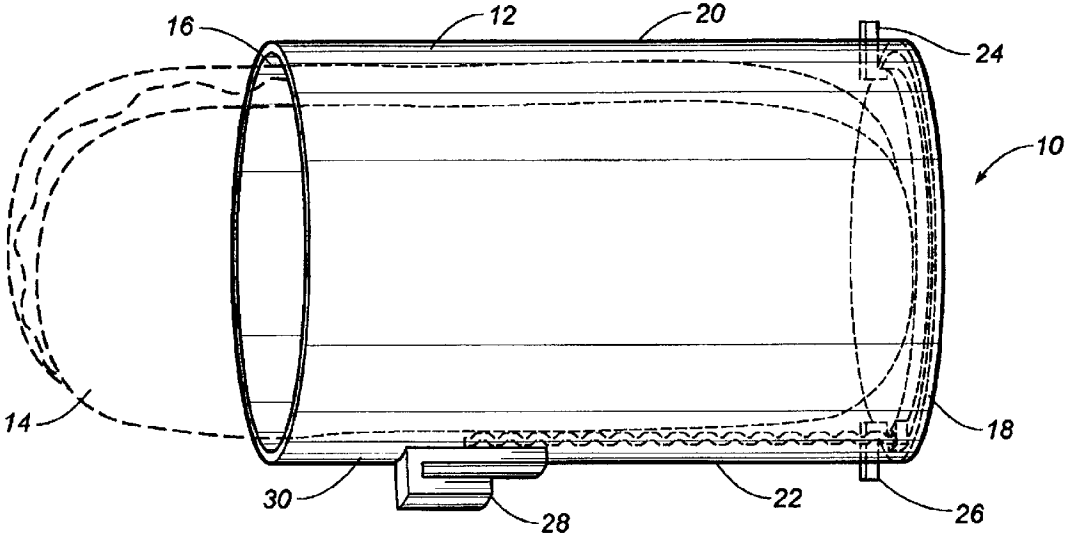
FIG. 1 is a perspective view showing the device of the present invention with a sandwich contained therein.

Referring to FIG. 1, there is shown at 10 the device for dispensing sandwiches in accordance with the preferred embodiment of the present invention. The device 10 includes a tubular body 12 having a generally oval cross-section A sandwich 14 is illustrated as received within the open end 16 of the tubular body 12. As will be described hereinafter, a disk member is positioned interior of the tubular body 12 so as to gradually move the sandwich 14 forwardly and outwardly of the open end 16 of the tubular body 12 as the sandwich 14 is being consumed. As can be seen in FIG. 1, the sandwich 14 is of a sub-type or hero-type configuration. The sandwich 14 is of a generally elongated configuration.

The tubular body 12 can be formed of a plastic or plexiglass material for supporting the sandwich. The walls of the tubular body 12 can be suitable flexible so that a retaining grip on the walls of the tubular body 12 can be placed upon the sandwich 14 so as to further retain the sandwich 14 interior of the tubular body 12. The tubular body 12 has a closed end 18 opposite the open end 16. The tubular body 12 has a first slot 20 extending longitudinally-along and through a wall of the tubular body 12. Also, the tubular body 12 has a second slot 22 extending longitudinally along and through the wall of the tubular body 12. The disk member (not shown) includes a first arm 24 extending outwardly of the tubular body 12 through the first slot 20. The disk member (not shown) also includes a second arm extending outwardly and through the second slot 22. During the consumption of the sandwich 14, the user can push on the arms 24 and 26 so as to move the sandwich 14 forwardly and outwardly of the open end 16 of the tubular body 12. During the consumption of sandwich 14, any liquid or particle contents of the sandwich 14 will be retained within the interior of the tubular body 12.

So as to facilitate the ability to attach the tubular body to an exterior object, a spring clip 28 is secured to the exterior surface 30 of the tubular body 12. The spring clip 28 is suitable for attaching the tubular body 12 to dashboards, car doors, desk drawers, etc. The position of the spring clip 28 assures that the sandwich 18 is retained upwardly in a vertical orientation. As such, any liquid contents of the sandwich 14 will continue to be retained within the interior of the tubular body 12. The spring clip 28 can have a surface that is adhesively attached to the exterior surface of the tubular body 12. Alternatively, the spring clip 28 can be integrally formed with the tubular body 12.

Figure 2:
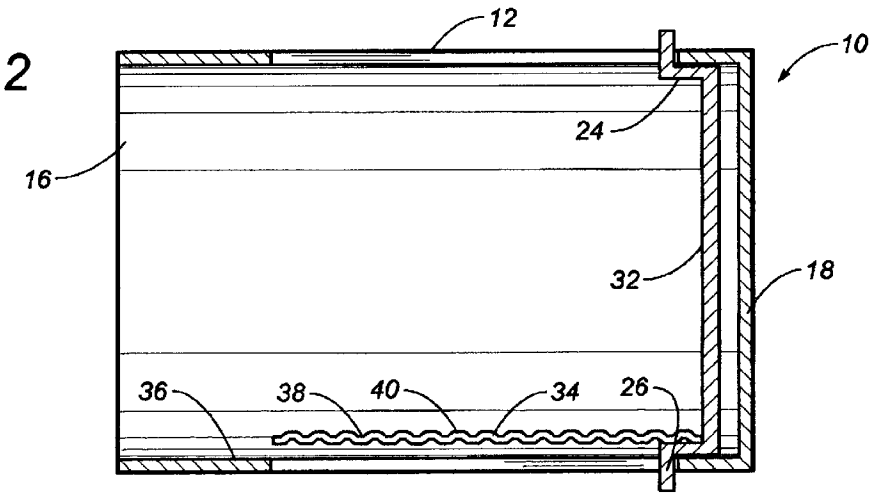
FIG. 2 is a cross-sectional view of the device of FIG. 1.

FIG. 2 shows the interior configuration of the device 10 of the present invention. The FIG. 2, it can be seen that the tubular body 12 has a generally longitudinal orientation. The tubular body 12 has open end 16 and closed end 18.

Importantly, disk member 32 is illustrated as being a solid planar member positioned adjacent to the closed end 18. The disk member 32 has first arm 24 extending forwardly and outwardly therefrom. Similarly, the disk member 32 includes the second arm 26 extending forwardly and outwardly therefrom. Each of the arms 24 and 26 will respectively extend outwardly through the first slot 20 and the second slot 22 of the tubular body 12. A fixing means 34 is positioned interior of the tubular body 12 adjacent to an interior wall 36 of the tubular body 12. The fixing means 34 serves to set a position of the disk member 32 within the tubular body 12 along a length of the tubular body 12. Specifically, the fixing means 34 includes a guide rod 38 affixed to the inner wall 36 of the tubular body 12. The guide rod 38 has a plurality of fixing elements 40 extending radially inwardly therefrom. These fixing elements are of a ratchet type configuration so as to retain the disk member 32 at a desired position when the disk member 32 is moved to a desired position along the length of the guide rod 38. The guide rod 38 extends for less than the entire length of the tubular body. The guide rod 38 can be formed of a metal or plastic material. The disk member 32 will have a suitable hole formed therein which fits on the guide rod 38. The disk member 32 can be fixed on the guide rod 38 when a slight force is applied by the sandwich onto the surface of the disk member 32. This causes the disk member 32 to lean slightly so as to cause the edges of the hole to exert a force against one of the fixing elements 40 on the guide rod 38.

Figure 3:
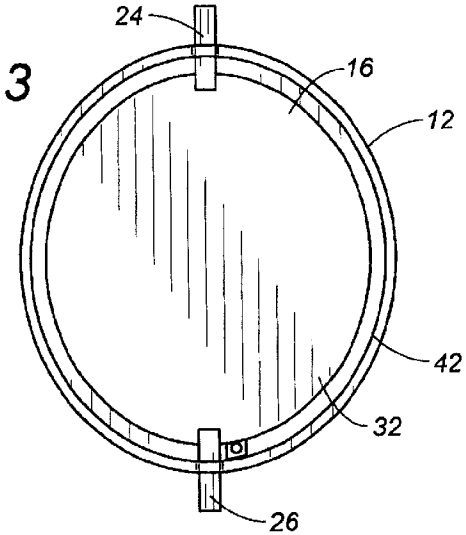
FIG. 3 is an end view of the device of the present invention.

FIG. 3 shows the end view of the tubular body 12. It can be seen in FIG. 3 that the tubular body 12 is a generally oval cross-section. The end 16 has an oval opening so as to allow for the introduction of the sub-type sandwich 14 therein. Arms 24 and 26 extend radially outwardly through the wall 42 of the tubular body 12. In this position, the user can easily manipulate the arms 24 and 26 so as to move the disk member 32 through the interior of the tubular body 12.

Figure 4:
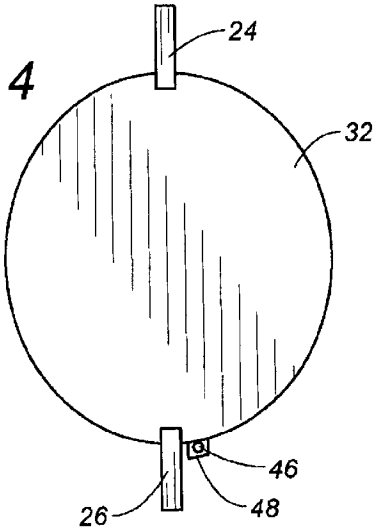
FIG. 4 is an isolated view of the disk member as used in interior of the tubular body of the device of the present invention.

FIG. 4 is an isolated view of the disk member 32. Disk member 32 has a first arm extending outwardly from one side thereof and a second arm 26 extending outwardly from an opposite side thereof. The arms 24 and 26 are radially opposite to each other. A hole 46 is formed in a surface 48 associated with the periphery of the disk member 32. The surface 48 is configured such that the hole 46 will fit around the guide rod 38 so as to allow the disk member 32 to move therealong. The surface 48 also is configured to fixedly engage the fixing elements 40 when an angular force is applied to the disk member 22, as described hereinbefore.

Figure 5:
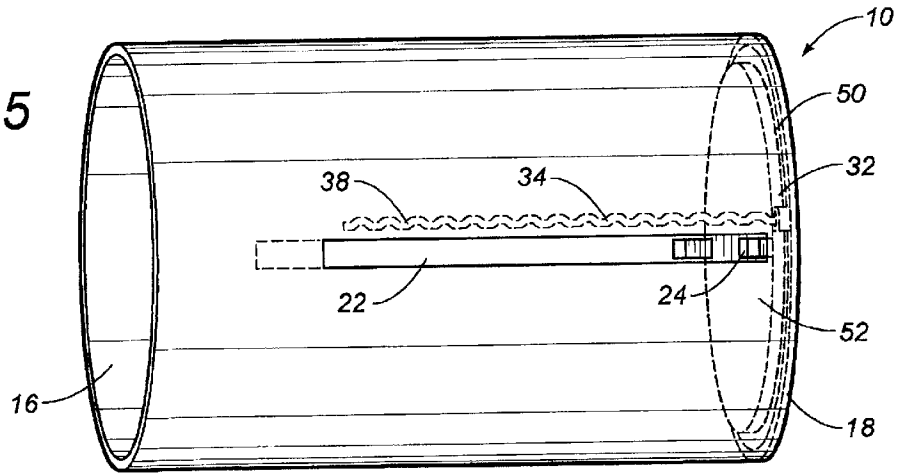
FIG. 5 is a transparent plan view of the device of the present invention.

FIG. 5 is a transparent view of the device 10 of the present invention. In particular, the device 10 includes tubular body 12 having open end 16 and closed end 18. The tubular body 12, and the closed end 18 are illustrated in transparent fashion so that the interior structure of the device 10 can be seen.

In FIG. 5, it can be seen that the disk member 32 is positioned adjacent to the closed end 18 initially. The disk member 32 is illustrated as having a ring 50 extending therearound supporting an interior structure 52. It is to be noted that the disk member 32 can have a wide variety of other configurations. The arm 24 is particularly illustrated as having a T-shaped structure extending adjacent to the interior wall of the tubular body 12. The outwardly extending projection through the slot at the top of the tubular body 12 is shown in FIG. 4. The fixing means 34 is illustrated in the form of guide rod 38 extending longitudinally along the interior of the tubular body 12. Similarly, the slot 22, at the bottom of the tubular body 12, is particularly illustrated.

During use, the user can initially insert the sandwich into the open end 16 of the tubular body 12 such that one end of the sandwich will abut the disk member 32 adjacent to the closed end 18 of the tubular body 12. A portion of the sandwich may extend outwardly of the open end 16. The device can then be transported into a vehicle, or other location, for consumption. During consumption, the disk member 32 can be moved forwardly along the fixing means 34 through the manipulation of the arms 24 and 26 extending outwardly of the tubular body 12. As a result, new portions of the sandwich will become exposed at the open end 16. Any dripping contents of the sandwich will be retained within the closed interior of the tubular body 12. If interruptions in consumption should occur, then the spring clip 28 can be secured to an exterior surface. As a result, the tubular body 12 will be retained in a vertical orientation. The user can continue to consume the sandwich until the disk member 32 extends to its end position adjacent to the open end 16 of the tubular body 12. The remaining portion of the sandwich can then be removed from the interior of the tubular body 12 and the tubular body 12 disposed of. Other certain circumstances, the tubular body 12 can be disposed of or can be washed and retained for future use. If the sandwich is only partially consumed, then the disk member 32 can be returned to its position adjacent the closed end 18 so that the sandwich is fully retained interior of the tubular body.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A device for dispensing a sandwich comprising:

a tubular body having an oval cross-section dimensioned and shaped to receive the sandwich, said tubular body having a slot extending longitudinally along and through a wall of said tubular body;

a disk member positioned interior of said tubular body, said disk member having an arm extending outwardly therefrom, said arm extending outwardly of said tubular body through said slot, said wall of said tubular body being flexible, said tubular body having a closed end and an open end, said disk member positioned adjacent said closed end; and a guide rod non-centrally positioned entirely within said tubular body spaced from and adjacent to said wall of said tubular body, said guide rod passing through a portion of said disk member such that said disk member is slidably attached to said guide rod, said guide rod comprising a plurality of fixing elements, said plurality of fixing elements being suitable for retaining said disk member at desired positions within said tubular body when said disk member is moved along a length of said guide rod, such that when the sandwich is placed in said tubular body and abuts said disk member, new portions of the sandwich become exposed at said open end of said tubular body when said arm is moved along said slot toward said open end, thus moving said disk member and the sandwich.

2. The device of claim 1, said disk member being a solid planar member extending transverse to a longitudinal axis of said tubular body.

3. The device of claim 1, said slot comprising:

a first slot extending along and through said wall of said tubular body; and a second slot extending along and through said wall of said tubular body on an opposite side of said tubular body from said first slot.

4. The device of claim 3, said arm comprising:

a first arm extending through said first slot; and a second arm extending through said second slot.

5. The device of claim 1, said guide rod extending for less than an entire length of said tubular body.

6. The device of claim 1, further comprising:

a spring hook affixed to an exterior surface of said tubular body.

7. A device for dispensing a sandwich comprising:

a tubular body having a slot extending longitudinally and through a wall of said tubular body, said tubular body dimensioned and shaped to receive the sandwich therein, said tubular body having a closed end and an open end;

a disk member positioned interior of said tubular body, said disk member having an arm extending outwardly therefrom, said arm extending outwardly of said tubular body through said slot, said disk member positioned adjacent said closed end; and a fixing means positioned interior of said tubular body, said fixing means for setting a position of said disk member within said tubular body along a length of said tubular body, said fixing means comprising a guide rod having a ratcheted surface, said disk member having a hole through which said guide rod extends so that the disk member is slidable along said guide rod, said guide rod being non-centrally positioned within said tubular body adjacent to and spaced from said wall of said tubular body, said guide rod extending entirely within said tubular body, said fixing means being suitable for retaining said disk member at desired positions within said tubular body when said disk member is moved along a length of said guide rod, such that when the sandwich is placed in said tubular body and abuts said disk member, new portions of the sandwich become exposed at said open end of said tubular body when said arm is moved along said slot toward said open end, thus moving said disk member and the sandwich.

8. The device of claim 7, said tubular body having an oval cross-section, said wall of said tubular body being flexible.

9. The device of claim 7, said disk member being a solid planar member extending transverse to a longitudinal axis of said tubular body.

10. The device of claim 7, said slot comprising:

a first slot extending along and through said wall of said tubular body and a second slot extending along and through said wall of said tubular body on an opposite side of said tubular body from said first slot, said arm comprising a first arm extending through said first slot and a second arm extending through said second slot.

* * * * *